US007297124B2

(12) United States Patent
Fernandez

(10) Patent No.: US 7,297,124 B2
(45) Date of Patent: Nov. 20, 2007

(54) DEVICE FOR AUTOMATICALLY PERFORMING CV4 MASSAGE TECHNIQUE

(76) Inventor: Jorge Fernandez, 104 E. 40th St. Suite 604, Fort Lee, NJ (US) 10016

( * ) Notice: Subject to any disclaimer, the term of this patent is extended or adjusted under 35 U.S.C. 154(b) by 0 days.

(21) Appl. No.: 11/357,619

(22) Filed: Feb. 21, 2006

(65) Prior Publication Data

US 2007/0197940 A1 Aug. 23, 2007

(51) Int. Cl.
*A61H 7/00* (2006.01)

(52) U.S. Cl. ..... 601/18; 601/101; 601/103; 601/133; 601/134

(58) Field of Classification Search ..... 601/39, 601/25, 12, 98, 99, 101, 102, 103, 15, 18, 601/133, 134
See application file for complete search history.

(56) References Cited

U.S. PATENT DOCUMENTS

| | | | | |
|---|---|---|---|---|
| 5,933,890 | A * | 8/1999 | Codd | 5/636 |
| 6,327,727 | B1 * | 12/2001 | Bocharnikov | 5/713 |
| 7,003,803 | B1 * | 2/2006 | Lyden | 2/22 |
| 7,153,283 | B1 * | 12/2006 | Triolo et al. | 601/102 |
| 2002/0007195 | A1 * | 1/2002 | Wexler | 606/204.15 |

* cited by examiner

*Primary Examiner*—Danton DeMille

(57) ABSTRACT

A massage device comprising two compression rods on a stable base with a cushioned circumferential barrier to properly position the user's head. When activated, an internal motor moves the two rods together to provide cranial massage to the user. Additional user controls or heating can be included.

12 Claims, 5 Drawing Sheets

1
2
3
4
5
7

1
2
3

803
804
805
806
801
802
8

DEVICE FOR AUTOMATICALLY PERFORMING CV4 MASSAGE TECHNIQUE

BACKGROUND OF THE INVENTION

1. Field of the Invention

The invention relates to mechanical and electronic massage devices.

2. Description of the Related Art

Both professional massage therapy and massage devices are commonly used for both relaxation and therapeutic purposes. While massage devices offer significant convenience and cost advantages to the consumer when compared to professional massage therapy, there are a number of techniques not only completely unavailable from massage devices, but not available from all therapists.

The technique of compression of the fourth ventricle of the brain (CV4 technique, CV4 Massage, or simply CV4), in which the back of the subject's head is gently, slightly, and slowly compressed by the therapist, promotes relaxation and other physiological benefits, is such a technique.

As only certain therapists are capable of performing CV4, and there is no available device for performing the technique either, few who would benefit from this therapeutic technique have access to it. A device usable to perform CV4, either under the supervision of a therapist not personally able to perform the technique or independently by the subject, would make the benefits of this therapeutic technique available to many more people than it currently is.

BRIEF SUMMARY OF THE INVENTION

This invention is such a device. It is a machine that anyone can use to perform the CV4 technique and receive its benefits.

The present invention is a massage device comprising a base housing a motor and control system, a cushioned barrier mounted on the housing with a vertical projection at one end, and two cushioned compression rods linked to the motor, located so that when the user positions their head, the rods are in contact with either side of the occipital bone of the back of the user's head. When the device is activated, the compression arms are drawn together at a low speed, simulating the CV4 technique.

In the preferred embodiment, the rods are slightly curved, but they may also be straight. Power in the preferred embodiment is provided by disposable batteries, but it may also be provided by an internal rechargeable battery or direct AC or DC power. Additionally, the device can include a remote for control during its use without needing to access controls on the base and other features, such as a warming element located in the vertical projection, both of which are included in the preferred embodiment.

BRIEF DESCRIPTION OF THE SEVERAL VIEWS OF THE INVENTION

DETAILED DESCRIPTION OF THE INVENTION

Figure 1:
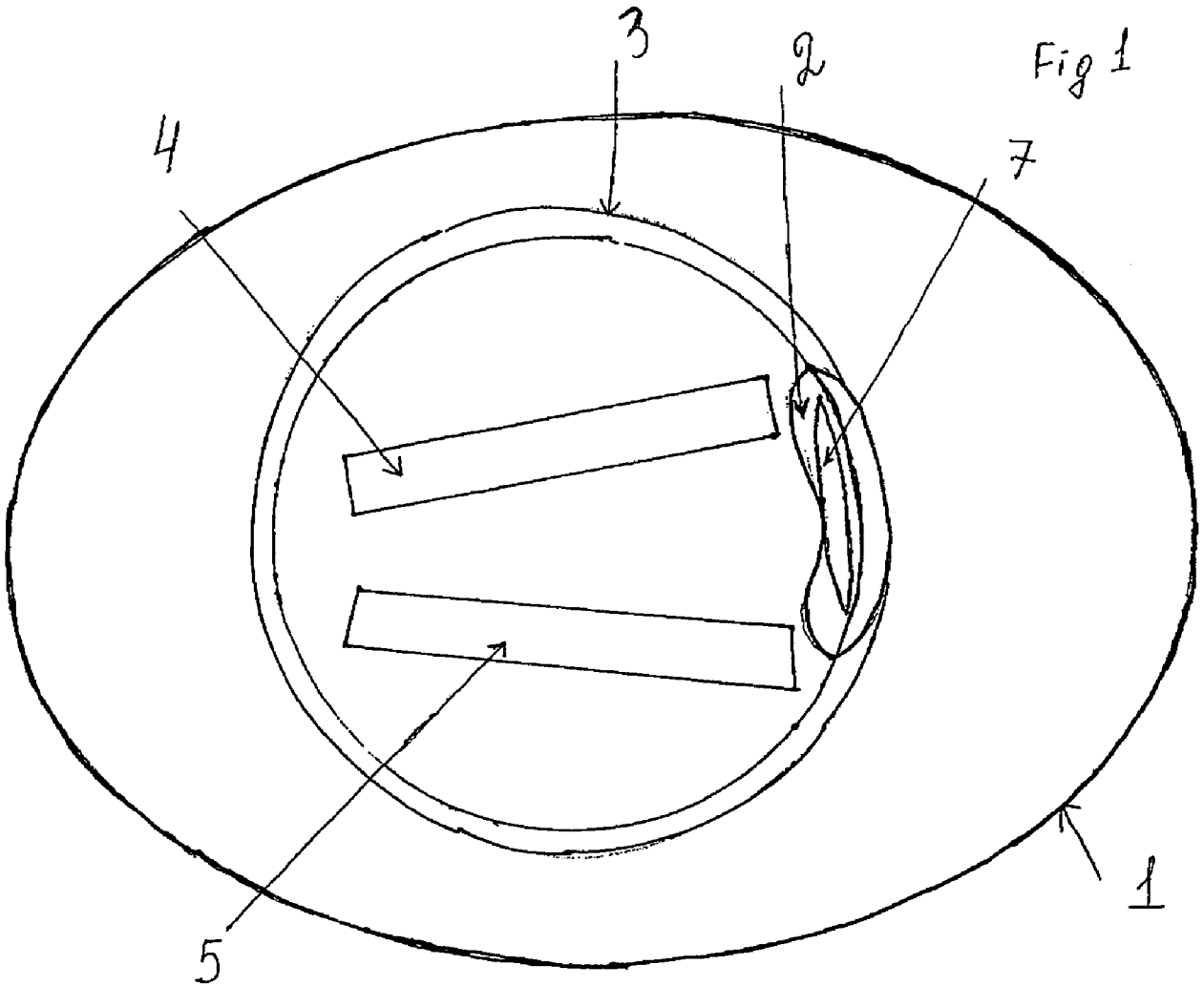
FIG. 1 is a top view of the preferred embodiment of the device.
Figure 2:
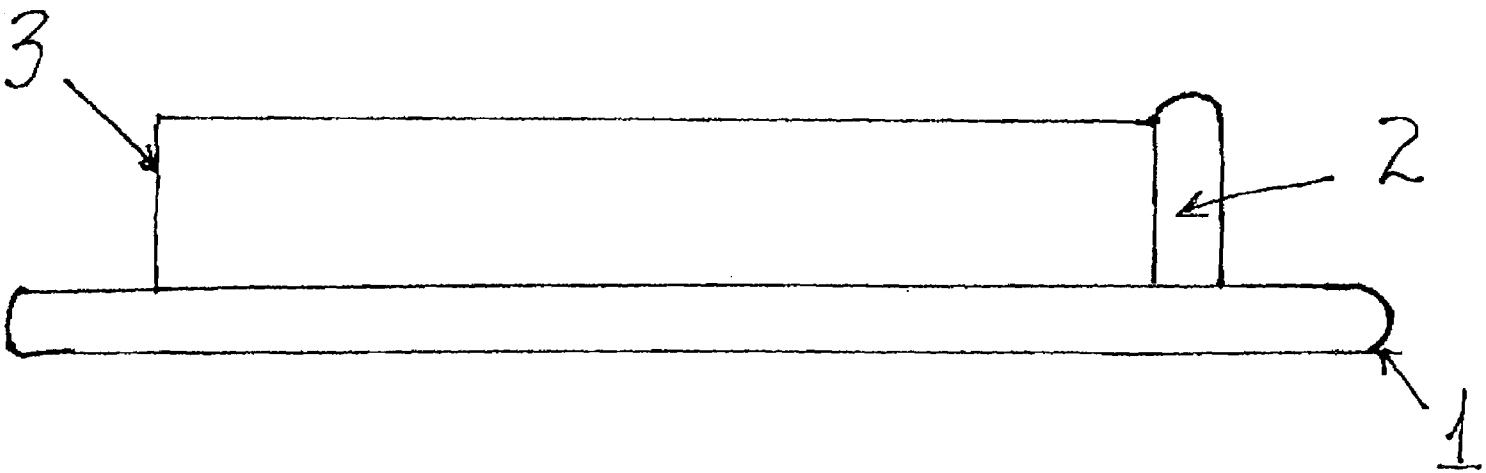
FIG. 2 is a side view of the device of FIG. 1.

As shown in FIG. 1, the device comprises a base 1, with vertical projection 2, a barrier 3 mounted on the base, and two compression arms 4 and 5.

Figure 3:
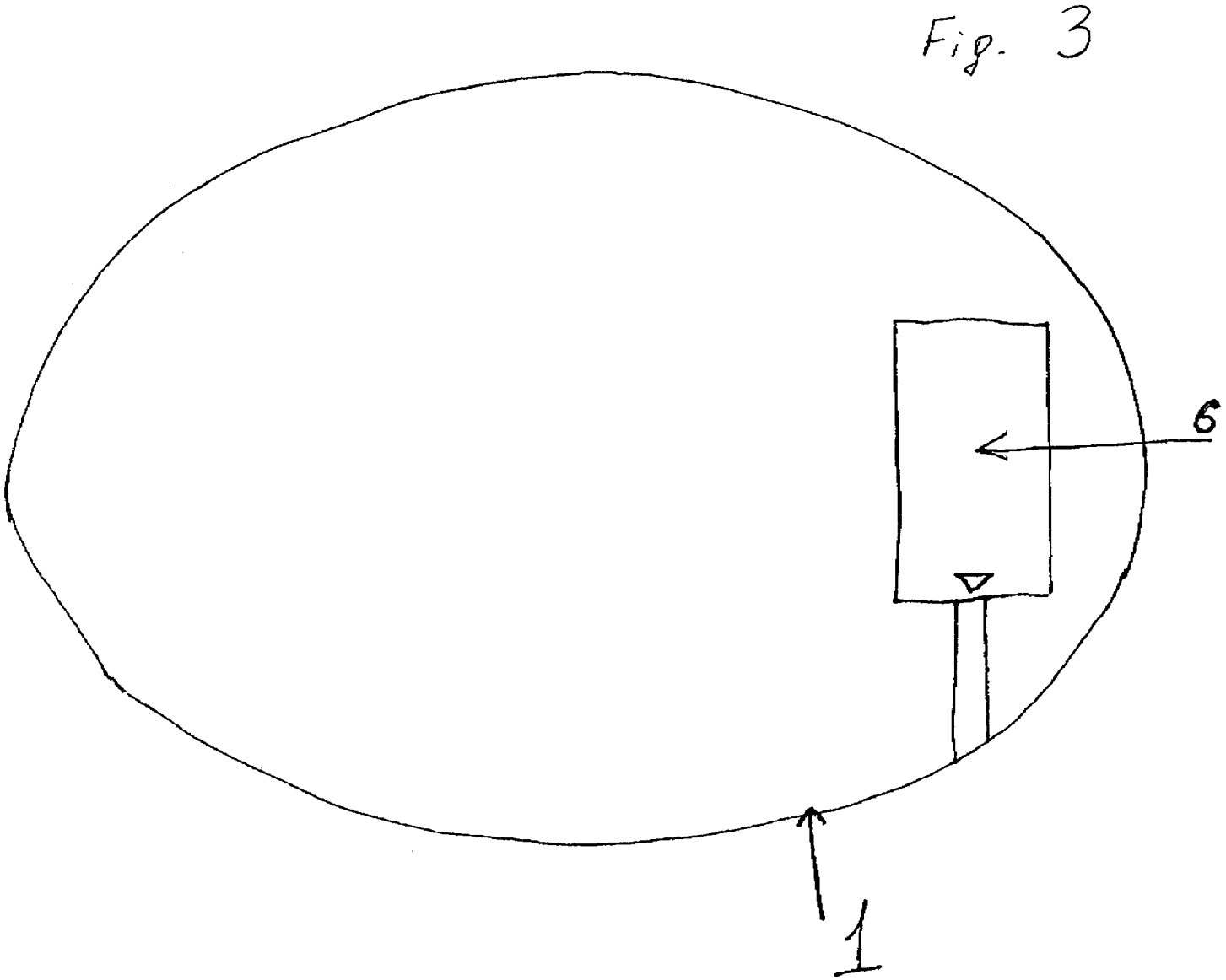
FIG. 3 is a bottom view of the device of FIG. 1.
Figure 4:
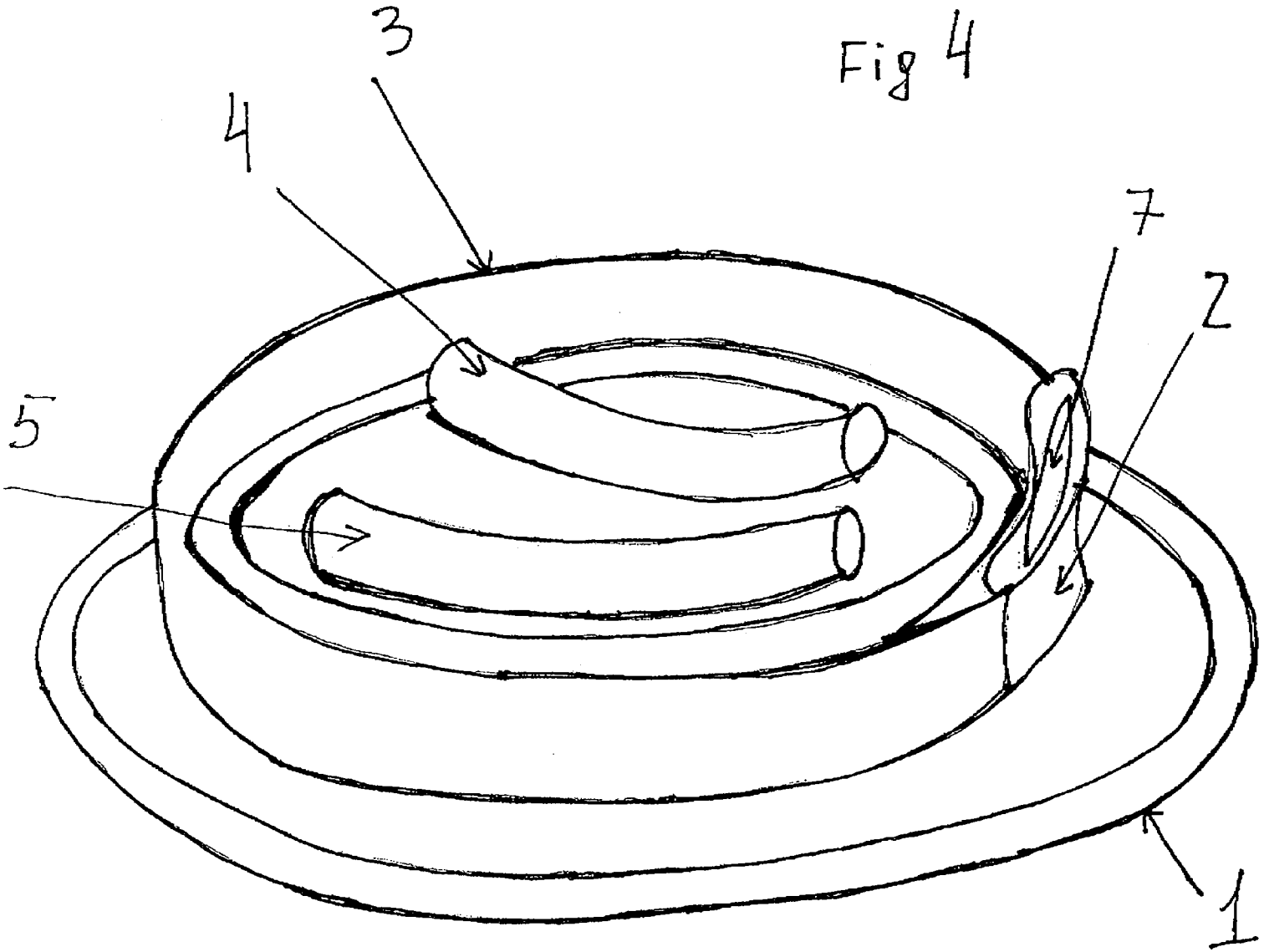
FIG. 4 is a three-quarters view of the device of FIG. 1.
Figures 5, 6:
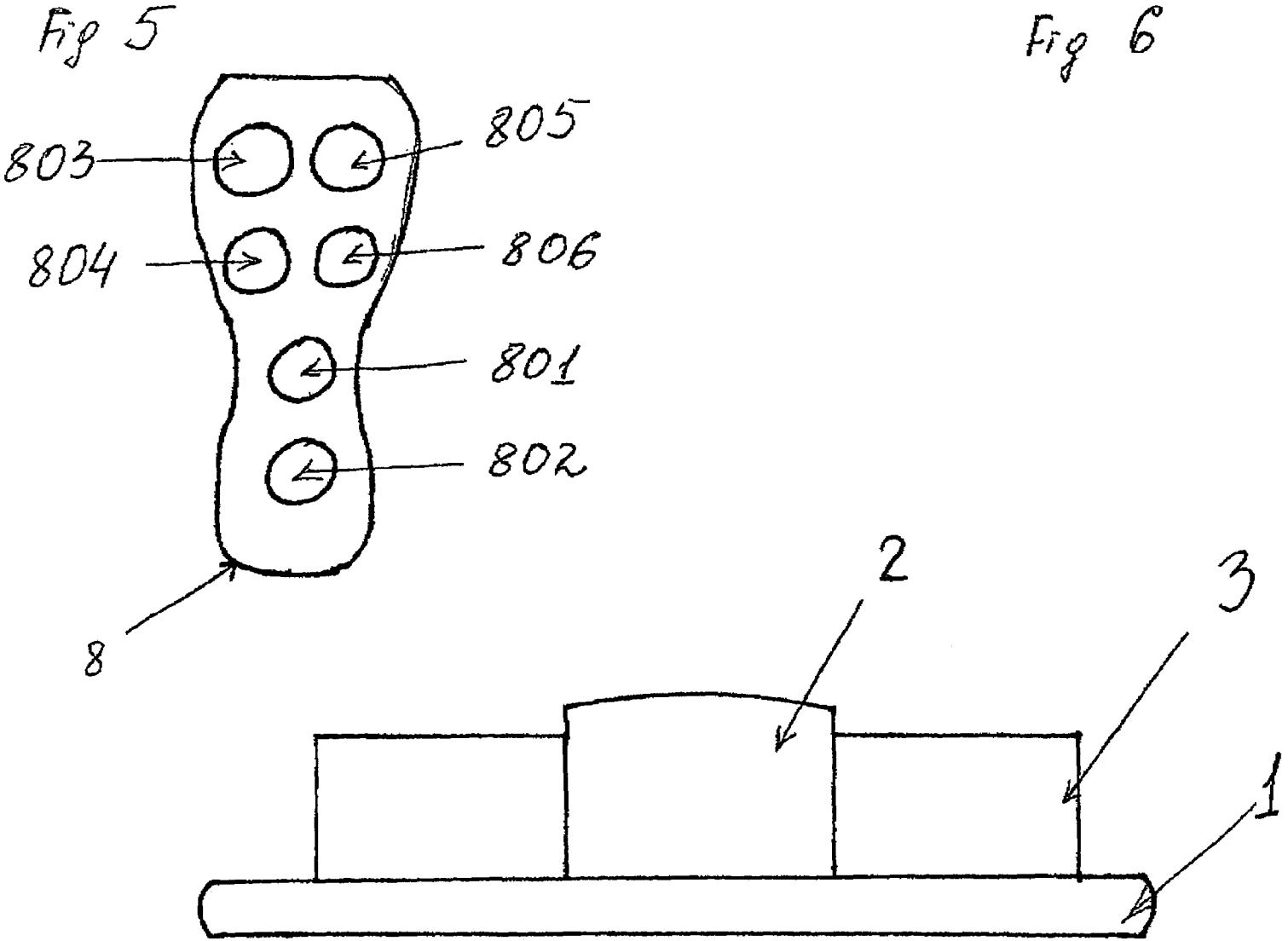
FIG. 5 is a top view of the remote control.
FIG. 6 is a front view of the device of FIG. 1.

The preferred embodiment, as shown in FIG. 3. includes a battery compartment 6, and as shown in FIG. 4. an infrared heating element 7. The remote control 8, depicted in FIG. 5. is the preferred control for the device.

The base 1 and barrier 3 may be composed of nearly any material. The vertical projection 2, in the preferred embodiment is plastic with an internally mounted infrared light. The compression arms 4 and 5 may be straight or slightly curved as they are in the preferred embodiment, and are metallic in the preferred embodiment, but may be composed of any material rigid enough to provide the compression necessary to the technique, and cushioned by soft rubber or other material The remote control 8 of the preferred embodiment has an on switch 801, an off switch 802, a heat-on switch 803, a heat-off switch 804, first program switch 805 and second program switch 806.

The motor and drive mechanism coupled to the compression rods may be of any sort capable of providing the necessary force for the technique. The control system can regulate the direction and speed of compression as in the preferred embodiment, an electronic system controlled by a remote. In other embodiments, controls may be incorporated into the base and control various aspects of the performance of the device.

When operated, the user places their head so that their head rests upon the compression arms 4 and 5. The vertical projection 2 aids in the positioning of the head. The compression arms are drawn together by the motor so as to perform CV4 technique on the back of the user's head, and in the preferred embodiment, the infrared light is activated to provide warmth.

What is claimed is:

1. A device comprising:

(a) a base having a top, a bottom, a front, a diametric axis, and sides;

(b) a projection of the base having a top, a bottom, a right side, and a left side, attached by said bottom to the top of the base close to the front of the top of the base;

(c) a curved barrier having a top, a bottom, a front end, and an aperture at said front end, attached by said bottom to the top of the base, said curved barrier having the projection within said aperture, so that the right and left sides of the projection are in contact with the barrier;

(d) a power source located within the base;

(e) a motor located within the base and connected to the power source;

(f) a control system capable of controlling the motor;

(g) a left compression rod, having a long axis, short axis, and any cross-sectional shape mounted on top of the base to the left of the diametric axis of said base, in the area enclosed by the barrier and oriented so that the long axis of said rod is parallel with the diametric axis of the base, said left compression rod coupled to the motor;

(h) a right compression rod, having a long axis, short axis, and any cross-sectional shape mounted on top of the base to the right of the diametric axis of said base, in the area enclosed by the barrier and oriented so that the long axis of said rod is parallel with the diametric axis of the base, said right compression rod coupled to the motor;

wherein, when the motor is activated, the left and right compression rods are drawn together to compress either side of the occipital bone for automatically performing CV4 technique.

2. The device of claim 1, wherein the power source is disposable batteries.

3. The device of claim 1, wherein the power source is an internal rechargeable power supply.

4. The device of claim 1, wherein the power source receives power from an external supply.

5. The device of claim 1, wherein the left and right compression rods are slightly curved.

6. The device of claim 1, wherein the control system is a remote control.

7. The device of claim 1, further comprising a heating device located inside the projection and connected to the power source and control system, said control system additionally capable of controlling said heating device.

8. The device of claim 7, wherein the power source is disposable batteries.

9. The device of claim 7, wherein the power source is an internal rechargeable power supply.

10. The device of claim 7, wherein the power source receives power from an external supply.

11. The device of claim 7, wherein the left and right compression rods are slightly curved.

12. The device of claim 7, wherein the control system is a remote control.

* * * * *